United States Patent [19]

Zagar

[11] Patent Number: 5,070,628

[45] Date of Patent: Dec. 10, 1991

[54] ROTATABLE SLOT NOZZLE AIR BAR

[75] Inventor: Steve J. Zagar, Green Bay, Wis.

[73] Assignee: W.R. Grace & Co.-Conn., New York, N.Y.

[21] Appl. No.: 465,771

[22] Filed: Jan. 16, 1990

[51] Int. Cl.[5] ..... F26B 13/00

[52] U.S. Cl. ..... 34/156; 34/23

[58] Field of Search ..... 34/155, 156, 23

[56] References Cited

U.S. PATENT DOCUMENTS

| | | | |
|---|---|---|---|
| 1,144,896 | 6/1915 | Fosbraey | 34/155 |
| 1,150,540 | 8/1915 | Ross | 34/155 |
| 3,771,236 | 11/1973 | Candor et al. | 34/23 |
| 4,328,626 | 5/1982 | Leitner | 34/155 |
| 4,869,157 | 9/1989 | Hungerford | 98/40.16 |

FOREIGN PATENT DOCUMENTS

| | | | |
|---|---|---|---|
| 2150796 | 4/1972 | Fed. Rep. of Germany | 34/155 |

*Primary Examiner*—Henry A. Bennet

*Assistant Examiner*—Denise L. Gromada

*Attorney, Agent, or Firm*—Hugh D. Jaeger; Kevin S. Lemack; William L. Baker

[57] ABSTRACT

A rotatable slot nozzle air bar utilizing a rotatable baffle assembly to directionally discharge air through an attached slot. The direction of discharge of the air is adjustable by a rotatable baffle assembly rotatably mounted within a surrounding outer housing. The rotatable slot nozzle air bar provides the ability to adjust the direction of impingement air on a web by controlling the rotation of the rotatable baffle assembly in the outer housing without changing out the air bar. The rotatable slot nozzle air bar provides the ability to profile the drying rate within the zone by directing the impingement air from the slot nozzle. The rotatable slot nozzle assembly is rotated to change direction of impingement air, thus allowing for operation using direct impingement, induced diffusional flow or a varying combination of either.

11 Claims, 6 Drawing Sheets

ROTATABLE SLOT NOZZLE AIR BAR

CROSS REFERENCES TO CO-PENDING APPLICATIONS

This patent application is related to a co-pending patent application entitled "Directional Diffusion Nozzle Air Bar", U.S. Ser. No. 07/465,470, filed Jan. 16, 1990, by Steven J. Zagar, and assigned to the same assignee as this patent application.

BACKGROUND OF THE INVENTION

1. Field of the Invention

The present invention pertains to air bars for drying, and more particularly, pertains to an air bar with a rotatable slot nozzle for directional air flow control and diffusion.

2. Description of the Prior Art

Various coatings applied to webs in the production of products, such as photosensitive films, requrie drying of the coatings with circulating air. In many cases, the direct impingement of circulating air on the wet coating of the film resulted in undesired movement of the wet coating caused by blowing air on the coating surface before the coating had sufficiently set. The prior art drying systems required continual adjustment so as to avoid disturbances of the wet coating and including the reducing or eliminating of direct impingement of air, such as from air jets of an air bar, while the coating was wet and not set.

Prior art methods of drying wet coatings usually have not changed the direction of the impinging air. Dampered air nozzles of air bars reduced the jet velocity from the dampered air nozzles, but also reduced the total mass air flow in the dampered air bars. Other prior art system involved the retraction of the air bars from the web, but this proved ineffective, in that the distance of the air bars from the web increased and did not provide for a profiling air velocity within a given zone or over a given distance of the web. The effects of these techniques for a slot nozzle are discussed in "Heat Transfer Characteristics of Impinging Two Dimensional Air Jets", by Robert Gordon and J. Cahit Akfirat, Journal of Heat Transfer, February, 1966, at 101.

It has been difficult for the prior designs of drying systems to provide a match of an exact drying profile for a specific coating on a web, such as a photosensitive film over a prescribed distance of the dryer length.

The present invention overcomes the disadvantages of the prior art by providing an air bar with a rotatable slot nozzle assembly which can be rotated to change the direction of air flow from the rotatable slot nozzle.

SUMMARY OF THE INVENTION

The general purpose of the present invention is an air bar with a directionally rotatable slot nozzle in an inner rotatable baffle assembly. The rotatable baffle assembly and nozzle slot provide for adjusting the direction of the continuous impingement air slot on a coated web within a given zone, so as to profile the air flow to dry and set the coating of the web for the web flow direction.

According to one embodiment of the present invention, there is provided an air bar including a feed port, an outer nozzle housing and an inner rotatable baffle assembly with a longitudinal slot attached thereto. The outer nozzle housing includes solid ends. The inner rotatable baffle assembly including the longitudinal slot is rotatably secured between the ends, and located at substantially the center of the partial round outer nozzle housing, and extending to the inner circumference of the outer nozzle housing. Two rotatably aligned baffles are connected at a common vertex which is also the pivot access. Seal wipers are located at each edge of the partial round outer nozzle housing to seal against the inner rotatable baffle assembly. By rotating the baffles of the inner rotatable baffle assembly and the slot nozzle about the pivot access, the air flow in the form of a continuous two dimensional air jet from the slot is directionally controlled.

Significant aspects and features of the present invention include a rotatable slot nozzle air bar with an internal rotatable nozzle baffle assembly which provides a structure for varying air convection within a specific drying zone consisting of a plurality of said rotatable slot nozzle for profiling air impingement velocity within the zone for enhanced drying to set and dry a coating, such as a coating on a photosensitive film web.

Having thus descirbed the embodiment of the present invention, it is a principal object hereof to provide an air bar with a rotatable slot nozzle. In one of the preferred embodiments, the slot nozzle assembly includes two aligned baffles and a slot nozzle aligned substantially perpendicularly to the baffles which pivot about a longitudinal axis of the rotatable baffle assembly.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
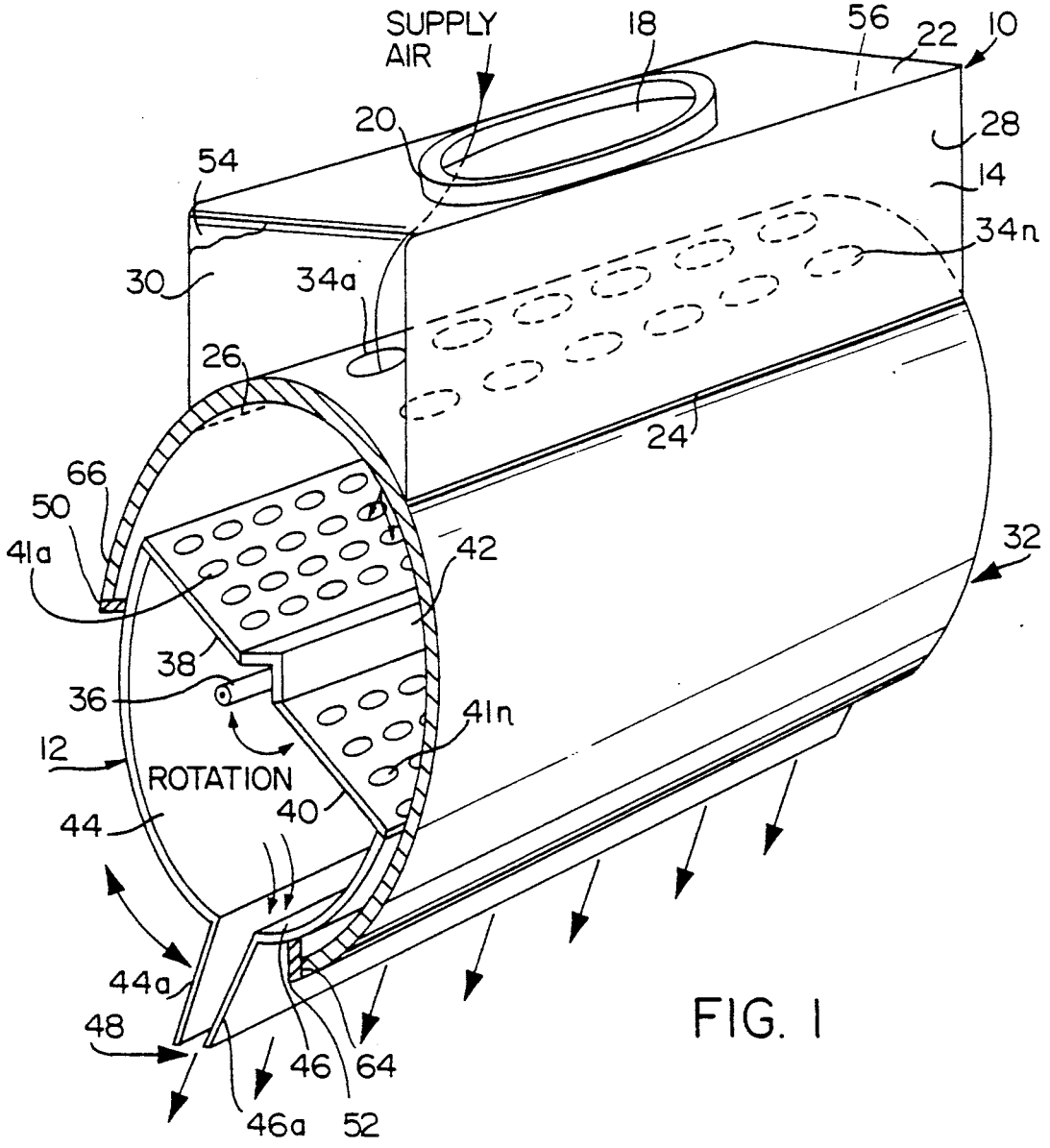
FIG. 1 illustrates a perspective view, partially cut away of a rotatable slot nozzle air bar with a rotatably adjustable baffle assembly.

FIG. 1 illustrates a perspective view in partial cutaway of a rotatable slot nozzle air bar 10 with an adjustable baffle assembly 12 as later described in detail. The rotatable slot nozzle air bar 10 includes a rectangular distribution chamber 14 with a feed port 18 and a surrounding gasket flange 20 located on the top surface 22.

The lower edges 24 and 26 of the top sides 28 and 30 of the distribution chamber 14 intersect a partially cylindrical nozzle housing 32. A plurality of holes 34*a*–34*n* are located in the upper portion on the nozzle housing 32 within the confines of the edges 24 and 26 of the distribution chamber 14. The adjustable baffle assembly 12 aligns within the inner periphery and along the central axis of the nozzle housing 32. The adjustable baffle assembly 12 includes a central rod 36 aligned an coinciding along the outer housing axis, and contiguous aligned holed baffle members 38 and 40 with an interceding "V" angle bend 42 between the holed baffle members 38 and 40 which aligns with and secures to the central rod 36. The baffles 38 and 40 include a plurality of air distribution holes 41*a*–41*n*. Rounded sections 44 and 46 secure to the outer ends of the holed baffle members 38 and 40, continue about a constant radius, and then are angled to form a continuous longitudinally aligned nozzle slot 48. The angled portions 44*a* and 46*a* extend radially from the rounded sections 44 and 46 to form the continuous nozzle slot 48, but may be formed angularly to obtain a desired nozzle air flow. Wiper seals 50 and 52 attach to the nozzle housing 32 and align at the lower edges 64 and 66, respectively, to seal against the outer periphery of rounded sections 44 and 46, respectively. End plates 54 (shown partially cutaway) and 56 extend vertically from the ends of the distribution chamber 14 across the opposing ends of the outer nozzle housing 32. Rotational movement of adjustable baffle assembly 12 is allowed between lower edges 64 and 66 of the nozzle housing 32. With a suitable design of nozzle housing 32 and adjustable baffle assembly 12, rotational movement in the range of 10° to 90° can be obtained by way of example and for purposes of illustration only and not to be construed as limiting of the present invention.

Figure 2B:
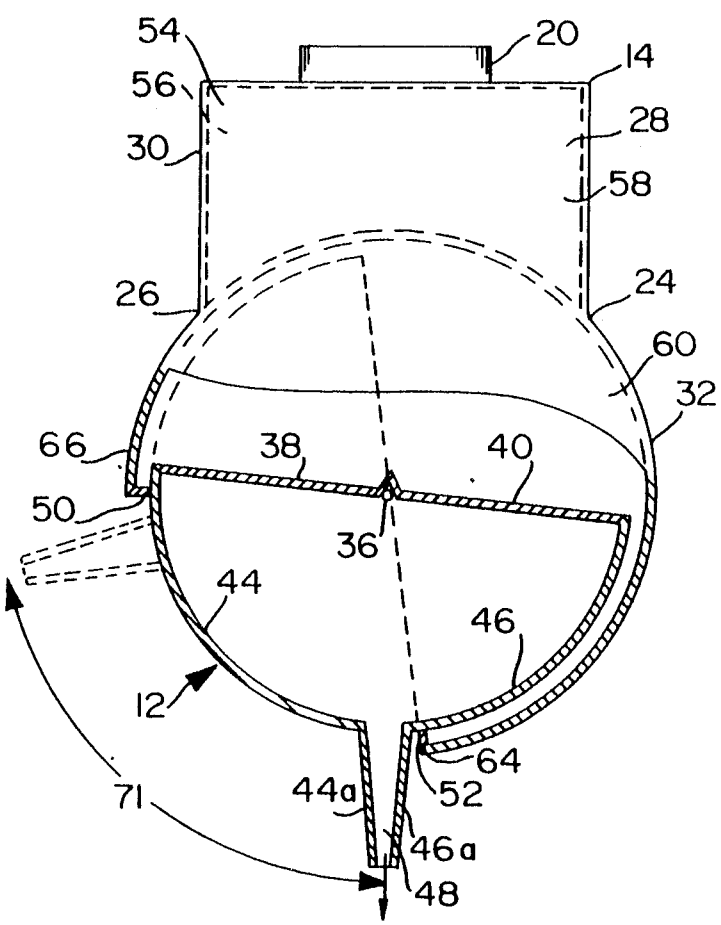
FIG. 2B illustrates a cutaway end view in partial cross section of a rotatable slot nozzle air bar.
Figure 2A:
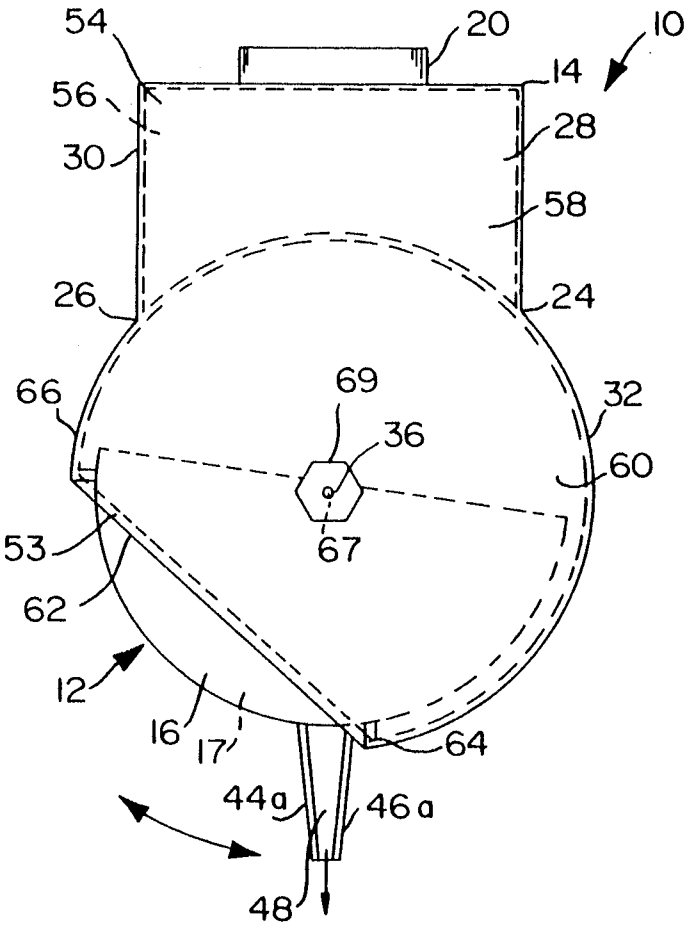
FIG. 2A illustrates an end view of a rotatable slot nozzle air bar with an adjustable baffle assembly.
Figure 5:
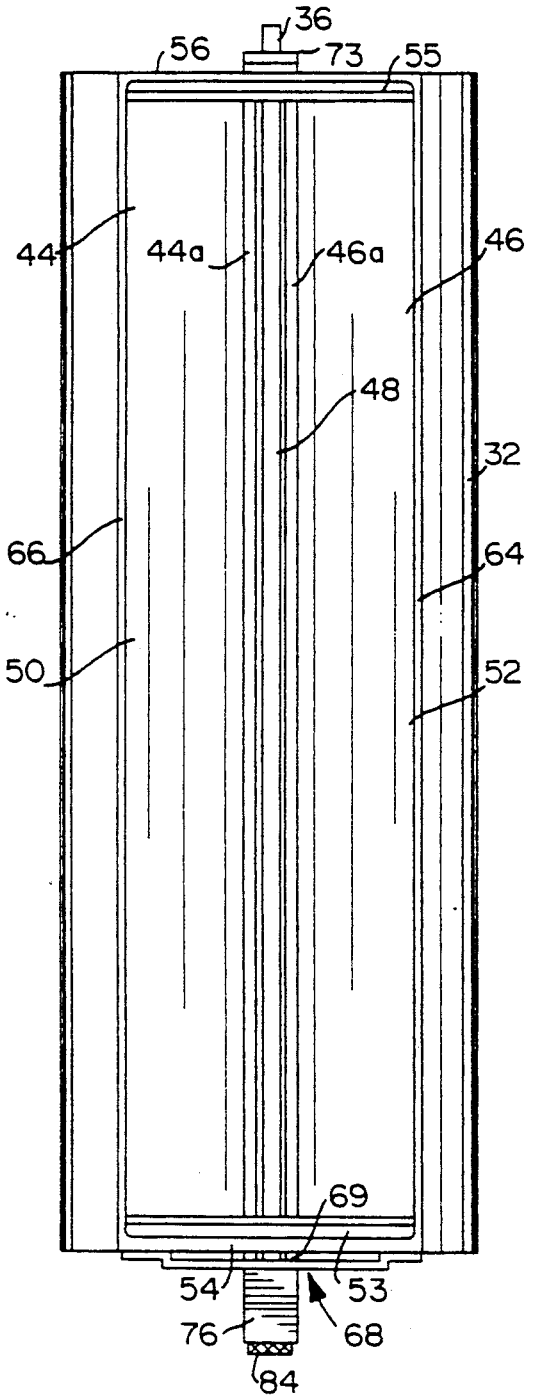
FIG. 5 illustrates a bottom view of the rotatable slot nozzle air bar.

FIG. 2A illustrates an end view of the rotatable slot nozzle air bar 10 where all numerals correspond to those elements previously described. Illustrated in particular is the end plate 54. The top portion 58 of the end plate 54 is generally rectangular in shape to conform to the shape of the distribution chamber 14, and the bottom portion 60 is generally round to conform to the end profile of the nozzle housing 32. The bottom portion 60 of the end plate 54 includes an edge 62 which aligns with the lower edges 64 and 66 of the nozzle housing 32. A wiper seal 53 is attached to the end plate 54 in line with edge 62 to seal against the baffle end plate 16 of the adjustable baffle assembly 12. A corresponding wiper seal 55 attaches to the opposing end plate 56 and against a baffle end plate 17 as also illustrated in FIG. 5. It is appreciated that the positioning can be effected at any intermediary position between those illustrated positions, which are by way of example and for purposes of illustration only and not to be construed as limiting of the present invention. The rod 36 extends through a hole 67 in the end plate 54 and through a corresponding hole in the opposing end plate 56. A packing gland 69 is attached to the end plate 54 concentric to the hole 67 to seal the penetration of rod 36. End plate 56 is similar in construction and not illustrated for sake of brevity.

FIG. 2B illustrates a cutaway end view in partial cross section of a rotatable slot nozzle air bar 10 where all numerals correspond to those elements previously described. The bottom portion 60 of the end plate 54 is cutaway for purposes of illustration to reveal the adjustable baffle assembly 12. Wiper seals 50 and 52 position at the lower edges 64 and 66 of the nozzle housing 32. The lower edges 64 and 66 are arcularly spaced to allow the nozzle slot 48 to be positionally rotated approximately along a 75° arc as illustrated by arc 71 as also illustrated by the dashed lines when rotated upwardly.

Figure 2C:
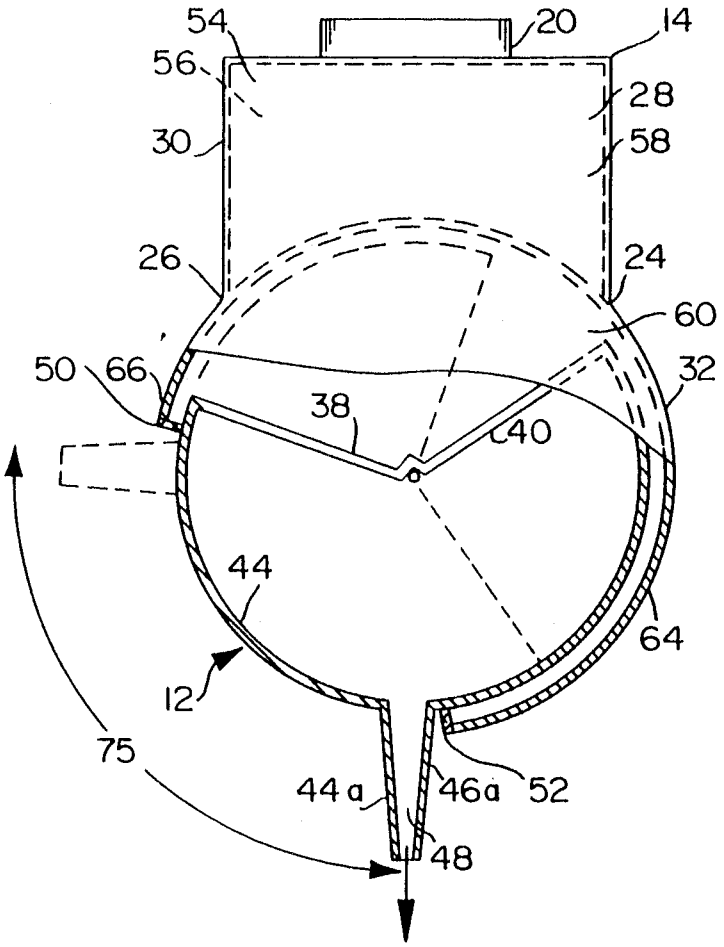
FIG. 2C illustartes an alternative embodiment cutaway end view in partial cross section of a rotatable slot nozzle air bar.

FIG. 2C, an alternative embodiment, illustrates a cutaway end view in partial cross section of a rotatable slot nozzle air bar assembly 10 where all numerals correspond to those elements previously described. The lower portion of the end plate 54 is cutaway for purposes of illustration to reveal the adjustable baffle assembly 12. The holed baffles 38 and 40 are angled upwardly towards each other to ultimately allow for a wider arcular swing of approximately 90° of the nozzle slot 48 along an arc 75 and between edges 64 and 66 which of course has a greater arcular spacing than that illustrated in FIG. 2B. This embodiment allows a range of rotation of the nozzle slot 48 from direct perpendicular impingement to nonimpinging induced flow at the web.

Figure 3:
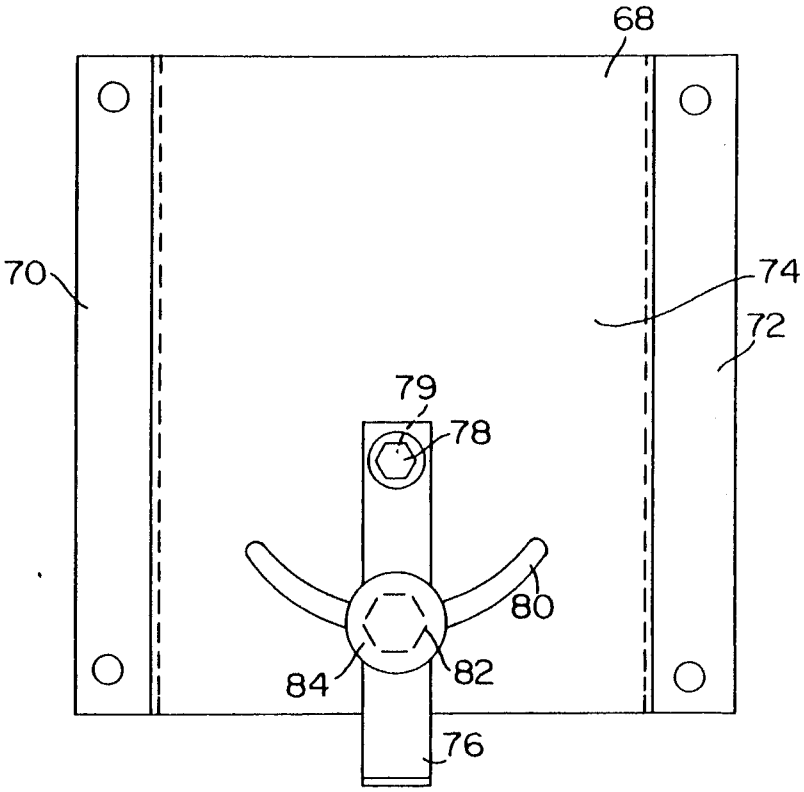
FIG. 3 illustrates an end view of the adjustment bracket of the rotatable slot nozzle air bar.

FIG. 3 illustrates an end view of a bracket 68 where all numerals correspond to those elements previously described. The bracket 68 includes mounting flanges 70 and 72, and a raised planar portion 74 between the flanges. The bracket 68 aligns with the end plate 54 of the rotatable slot nozzle air bar 10 and is attached by screws or other suitable means. The rod 36 of FIG. 1 extends through the packing gland 69 and through a hole 79 in the raised planar portion 74 of the bracket 68 and secures into the adjustment handle 76 by means of a keyed fit and is retained by a pivot bolt 78 or other suitable means to allow for rotational adjustment of the baffles 38 and 40 which secure over and about the rod 36. A semicircular slot 80 is included in the raised planar portion 74 for accommodation of a threaded bolt 82 and a securing knob 84 which secure to the handle 76 in a predetermined position, thereby securing the baffles 38 and 40 in a predetermined position.

Figure 4:
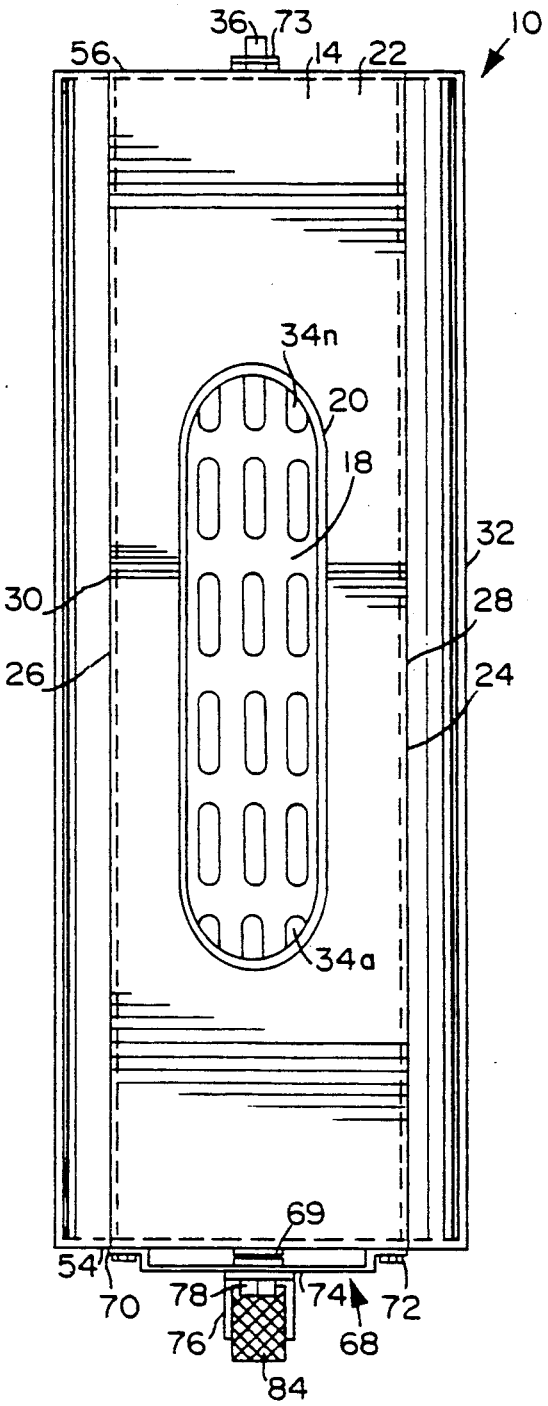
FIG. 4 illustrates a top view of the rotatable slot nozzle air bar.

FIG. 4 illustrates a top view of the rotatable slot nozzle air bar 10 where all numerals correspond to those elements previously described. Illustrated in particular is the bracket 68 aligned with the rotatable slot nozzle air bar 10 for rotational control of the adjustable baffle assembly 12 of FIG. 1 and nozzle slot 48 of FIG. 2 and also securing of the adjustable baffle assembly 12 and the nozzle slot 48 in a fixed position. A packing gland 73 aligns over the rod 36 and against the end plate 56.

FIG. 5 illustrates a bottom view of the rotatable slot nozzle air bar 10 where all numerals correspond to those elements previously described.

MODE OF OPERATION

Figure 6:
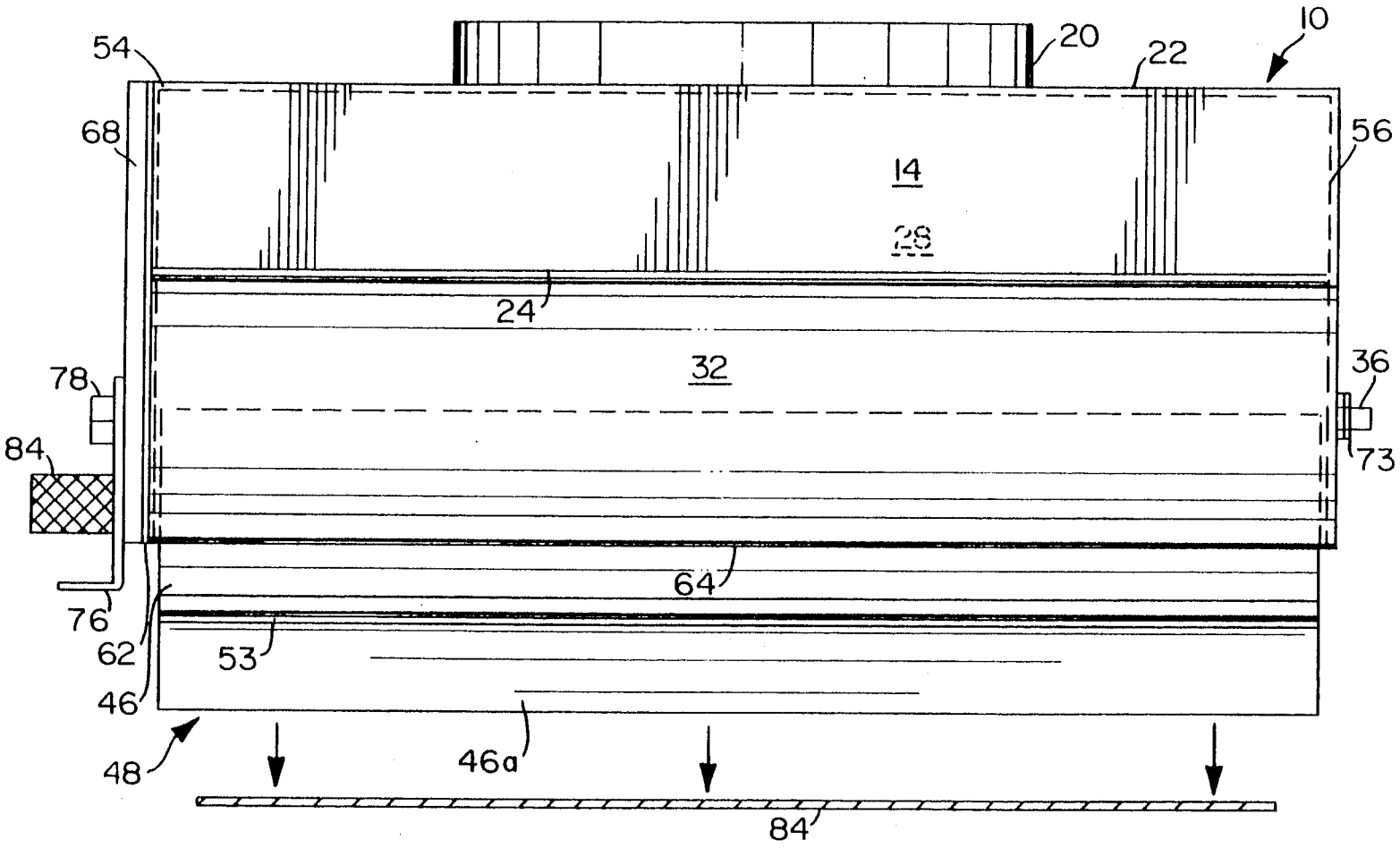
FIG. 6 illustrates a mode of operation of single side flotation with the adjustable nozzle baffles which can be retractable; and, FIG. 7 illustrates a mode of operation of a plurality of air foils and rotatable slot nozzle air bars on opposite sides of a traveling web.

FIG. 6 illustrates a rotatable slot nozzle air bar 10 aligned over a web 86. The rotatable slot nozzle 48 has been positioned to produce a desired impingement angle. Any impingement angle can be selected for the nozzle slot 48.

Figure 7:
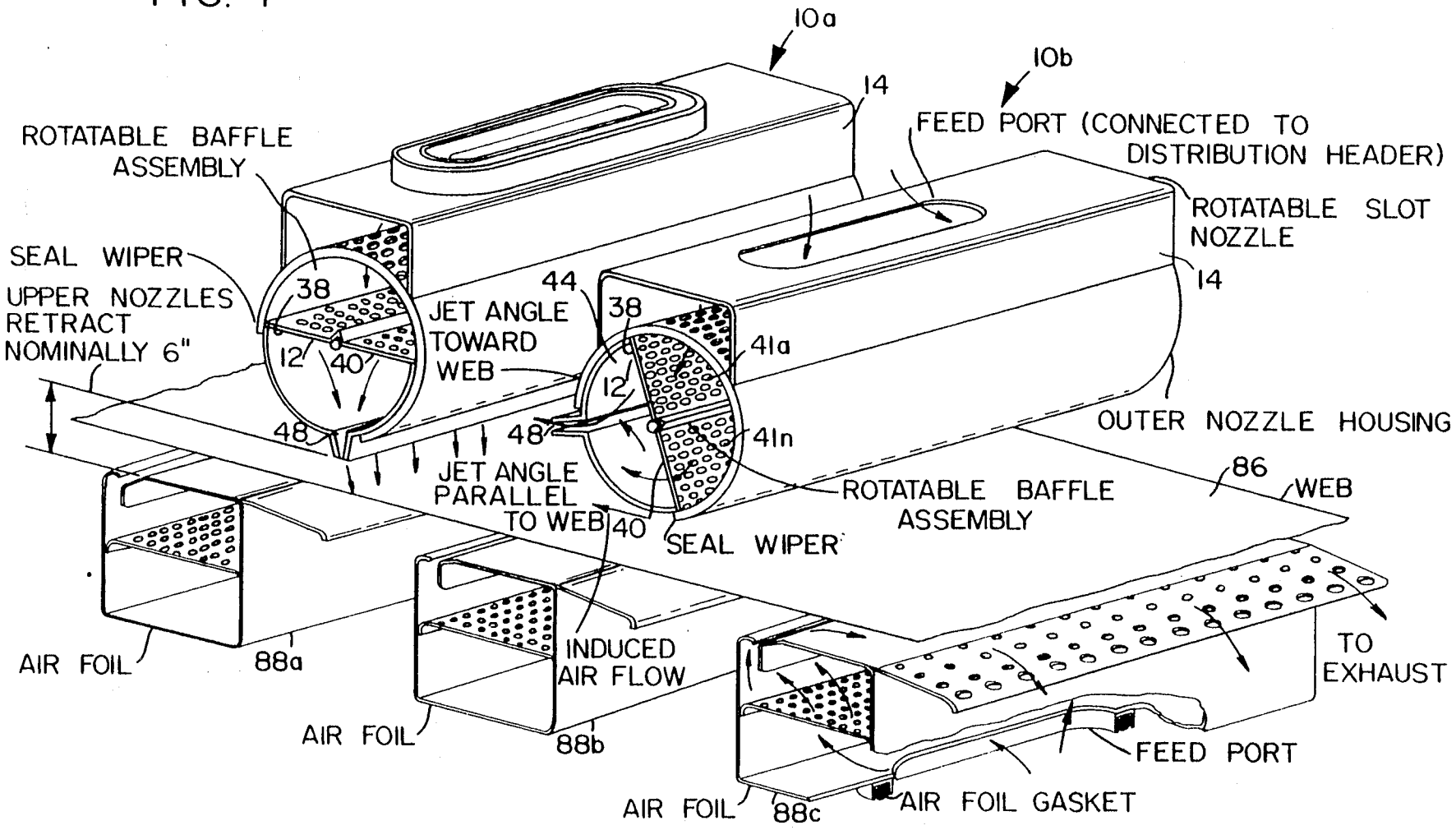

FIG. 7 illustrates one of the modes of operation of the plurality of air bars 10 where all numerals correspond to those elements previously described. Air bars 10*a* and 10*b*, each similar and like the air bar 10, align over and above the web 86. A plurality of air foils including air foils 88*a*, 88*b* and 88*c* are located on the underside of the web 86 to provide flotation. Optionally, the web may be supported by other structures such as idler rolls. The air bar 10*a* is aligned above and between the air foils 88*a* and 88*b*, and the air bar 10*b* is aligned above and between the air foils 88*b* and 88*c*. This same alternating arrangement of the air bars and air foils continue along the length of the web for a desired distance. The air bars and air foils connect to headers for appropriate supply of air such as in a dryer like that disclosed in U.S. Pat. No. 3,739,498, entitled "High Velocity Air Web Dryer", and assigned to the same assignee of this patent application by way of example and for purposes of illustration only and not to be construed as limiting of the present invention.

The adjustable baffle assembly 12 is adjusted by the handle 76 as described in the previous figures to rotationally position the baffles to obtain the desired drying air flow out of the nozzle slot 48. Nozzle slot 48 of adjustable baffle assembly 12 in the air bar 10*a* is essentially positioned at the 6 o'clock position, causing air from the distribution chamber 14 to flow around and through the plurality of holes in baffles 38 and 40. The drying air impinges directly on web 86. In the air bar 10*b*, the nozzle slot 48 is positioned at the 9 o'clock position, causing air from the diffusion plate to flow around the rounded section 44 and through the air distribution holes 41*a*–41*n* in baffles 38 and 40. Air flows to the side and out of the nozzle slot 48 and across the web 86 instead of directly straight on impingement as depicted beneath the air bar 10*a*. While in this embodiment, two positions for the adjustable baffle assembly 12 are disclosed by way of example and for purposes of illustration only and not to be construed as limiting of the present invention, the teachings of the disclosure can include different positioning of the adjustable baffle assembly 12.

In one of the modes of operation, a drying zone having a plurality of the rotatable slot nozzles is configured as illustrated in FIG. 7. Starting from the first nozzle 10*b* nearest the web entering end of the zone, adjustable baffle assembly 12 is positioned by means of adjustment handle 76 such that the jet from nozzle slot 48 is directed substantially parallel to the surface of web 86. The air jet does not impinge on the web surface and induces surrounding air into motion by entrainment, thereby effecting minimal air convection forces on the wet coating. Adjacent nozzles in the direction of web travel are similarly adjusted until the coating has set sufficiently so as to be tolerant of greater air convection forces without disturbance of the coating. Subsequent nozzles in the direction of web travel are adjusted so as to position their respective rotatable baffle assemblies to direct each air jet at progressively greater angles of incidence to the web. The angles may increase up to and including perpendicular impingement for increased heat and mass transfer effectiveness.

Having thus described the preferred modes of the present invention, those of skill in the art will be readily able to apply the teaching found herein to various other systems for applying pressurized air to a traveling web of material an adjustable impingement angle without deviating from the scope of the claims hereto attached.

I claim:

1. Apparatus for directing a stream of gas into contact with a floating substantially longitudinal traveling web of material comprising:

a. chamber located near a substantially longitudinal traveling web of material;

b. source of pressurized gas coupled to said chamber;

c. slot nozzle means coupled to said chamber for directing said pressurized gas out of said chamber and into contact with said traveling web of material; and d. means rotatably positioned in said directing means for altering the angle of impingement of said pressurized gas with said traveling web of material.

2. Apparatus according to claim 1 wherein said altering means comprises means for adjusting the angle of said slot nozzle relative to said traveling web.

3. Apparatus according to claim 2 wherein said adjusting means further comprises a partial cylinder including said slot nozzle rotatably coupled to said chamber.

4. Apparatus according to claim 3 wherein said partial cylinder is rotatably coupled to said chamber about the longitudinal axis of said partial cylinder.

5. Apparatus of claim 4 further comprising means responsively coupled to said partial cylinder and said chamber for maintaining said slot nozzle at a preselected angle relative to said traveling web.

6. Rotatable slot nozzle air bar comprising:

a. a feed port for connection to a distribution header;

b. a distribution chamber connected to said feed port;

c. an outer circumferential nozzle housing connected to said distribution chamber; and, d. an inner rotatable baffle means including a nozzle means rotatably positioned in said circumferential nozzle housing and rotatably mounted between ends of said outer nozzle housing.

7. Rotatable slot nozzle air bar comprising:

a. a feed port for connection to a distribution header;

b. a distribution chamber connected to said feed port;

c. an outer circumferential nozzle housing connected to said distribution chamber;

d. an inner rotatable baffle means including a nozzle means partially positioned in said circumferential nozzle housing and rotatably mounted between ends of said outer nozzle housing; and, e. means connected to said inner rotatable baffle means for securing said nozzle means in a predetermined position.

8. Rotatable slot nozzle air bar for directing a stream of hot gas into contact with a traveling web of material comprising:

a. a chamber located near said traveling web of material;

b. a source of pressurized gas coupled to said chamber;

c. a slot nozzle means coupled to said chamber for directing said pressurized gas out of said chamber and into contact with said traveling web of material; and d. said slot nozzle means being rotatably positioned in said chamber for altering the angle of impingement of said pressurized gas with said traveling web of material, said altering means including means for adjusting the angle of said slot nozzle relative to said traveling web.

9. Rotatable slot nozzle air bar of claim 8 wherein said adjusting means further comprises a partial cylinder including said slot nozzle rotatably coupled within said chamber.

10. Rotatable slot nozzle air bar of claim 9 wherein said partial cylinder is rotatably coupled within said chamber about the longitudinal axis of said partial cylinder.

11. Rotatable slot nozzle air bar of claim 10 further comprising means responsively coupled to said partial cylinder and said chamber for maintaining said slot nozzle at a predetermined angle relative to said traveling web.

* * * * *